US009069367B2

(12) United States Patent
Nag et al.

(10) Patent No.: US 9,069,367 B2
(45) Date of Patent: Jun. 30, 2015

(54) REFERENCE VOLTAGE GENERATORS, INTEGRATED CIRCUITS, AND METHODS FOR OPERATING THE REFERENCE VOLTAGE GENERATORS

(71) Applicant: TAIWAN SEMICONDUCTOR MANUFACTURING COMPANY, LTD., Hsinchu (TW)

(72) Inventors: Dipankar Nag, Hsinchu (TW); Chewn-Pu Jou, Hsinchu (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 0 days.

(21) Appl. No.: 13/693,454

(22) Filed: Dec. 4, 2012

(65) Prior Publication Data

US 2013/0093504 A1 Apr. 18, 2013

Related U.S. Application Data

(63) Continuation of application No. 12/770,033, filed on Apr. 29, 2010, now Pat. No. 8,344,720.

(60) Provisional application No. 61/245,476, filed on Sep. 24, 2009.

(51) Int. Cl.

| | |
|---|---|
| ***G05F 3/08*** | (2006.01) |
| ***G05F 3/16*** | (2006.01) |
| ***G05F 3/30*** | (2006.01) |

(52) U.S. Cl.
CPC ... *G05F 3/16* (2013.01); *G05F 3/30* (2013.01)

(58) Field of Classification Search
USPC ..... 323/304, 311–317
See application file for complete search history.

(56) References Cited

U.S. PATENT DOCUMENTS

| | | | | |
|---|---|---|---|---|
| 6,163,187 | A * | 12/2000 | Sano | 327/157 |
| 7,061,298 | B2 | 6/2006 | Mentze et al. | |
| 7,411,380 | B2 | 8/2008 | Chang et al. | |
| 7,570,107 | B2 * | 8/2009 | Kim et al. | 327/539 |
| 7,683,696 | B1 * | 3/2010 | Le | 327/534 |
| 2006/0038608 | A1 * | 2/2006 | Ozawa | 327/539 |
| 2006/0176041 | A1 * | 8/2006 | Pletersek | 323/312 |
| 2007/0241728 | A1 * | 10/2007 | Demolli | 323/273 |
| 2009/0085549 | A1 * | 4/2009 | Sengupta et al. | 323/313 |

FOREIGN PATENT DOCUMENTS

| | | |
|---|---|---|
| CN | 101034535 | 9/2007 |
| CN | 101226414 | 7/2008 |

* cited by examiner

*Primary Examiner* — Jeffrey Gblende
(74) *Attorney, Agent, or Firm* — Lowe Hauptman & Ham, LLP

(57) ABSTRACT

A reference voltage generator is described. The reference voltage generator includes a proportional to absolute temperature (PTAT) current source, the PTAT current source being capable of providing a first current that is proportional to a temperature. The reference voltage generator further includes a current mirror comprising a first transistor and a second transistor, the current mirror configured to generate a second current proportional to the first current, wherein a ratio of the first current to the second current is equal to a ratio of a gate width of the first transistor to a gate width of the second transistor. The reference voltage generator further includes a voltage divider, the voltage divider being capable of receiving the second current, the voltage divider capable of outputting a reference voltage, the reference voltage being substantially independent from a change of the temperature.

18 Claims, 4 Drawing Sheets

REFERENCE VOLTAGE GENERATORS, INTEGRATED CIRCUITS, AND METHODS FOR OPERATING THE REFERENCE VOLTAGE GENERATORS

CROSS-REFERENCE TO RELATED APPLICATIONS

The present application is a continuation application of U.S. application Ser. No. 12/770,033, filed on Apr. 29, 2010, which claims priority of U.S. Provisional Patent Application Ser. No. 61/245,476 filed on Sep. 24, 2009, both of which are incorporated herein by reference in their entirety.

TECHNICAL FIELD

The present disclosure relates generally to the field of semiconductor circuits, and more particularly, to reference voltage generators, integrated circuits, and methods for operating the reference voltage generators.

BACKGROUND

Wireless communication devices and services have proliferated in recent years. Affordability and convenient access to personal communication services including cellular telephony (analog and digital), paging, and emerging so-called personal communication services (PCS) have fueled the continuing growth of a worldwide mobile communication industry. Numerous other wireless applications and areas show promise for sustained growth including radio frequency identification (RFID), various satellite-based communications, personal assistants, local area networks, device portability, etc.

RFID has been used in various applications, e.g., automatic transportation systems, identification cards, bankcards, etc. It has also been applied by incorporating into animals or persons for tracking and/or identification. The tracking and/or identification can be accomplished through radio frequency waves. RFID usually consists of an integrated circuit connected with an antenna. The antenna can transmit and receive signals. The integrated circuit can store and/or process information carried by the signals.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the numbers and dimensions of the various features may be arbitrarily increased or reduced for clarity of discussion.

DETAILED DESCRIPTION

Figure 1:
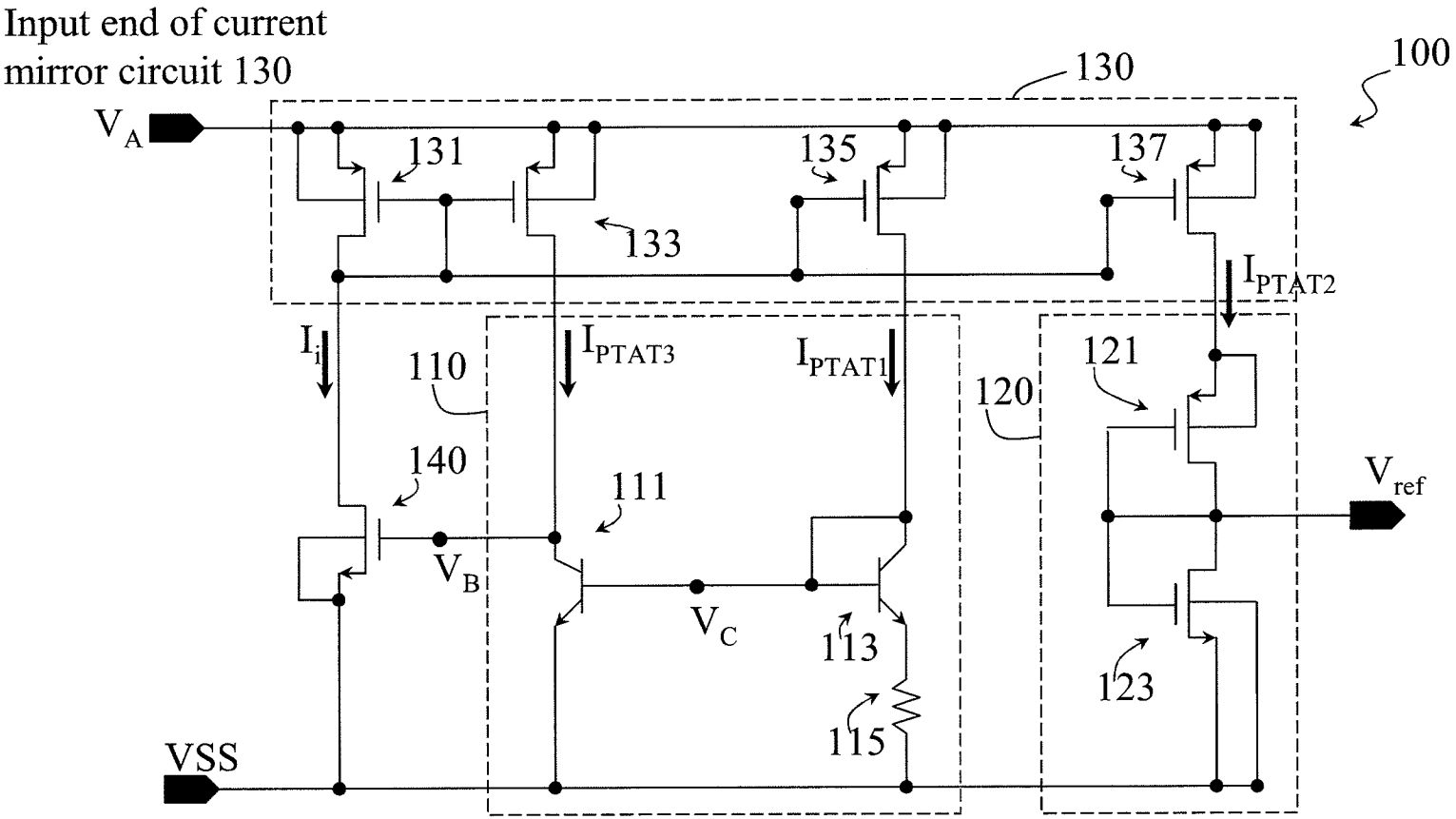
FIG. 1 is a schematic drawing illustrating an exemplary reference voltage generator.

A conventional RFID has a bandgap voltage reference circuit for providing a bandgap reference voltage that is independent from a variation of a temperature. A conventional bandgap voltage reference circuit has a proportional to absolute temperature (PTAT) current source. The PTAT current source can provide a PTAT current to a resistor R and a bipolar transistor that are coupled in series. The bandgap reference voltage output from the bandgap voltage reference circuit is the sum of a voltage drop $V_R$ cross the resistor R and a voltage drop $V_{BE}$ cross an emitter and a base of the bipolar transistor. The change of voltage drop $V_R$ in response to a change of temperature T, i.e., $dV_R/dT$, is positive. The change of the voltage drop $V_{BE}$ in response to the temperature T, i.e., $dV_{BE}/dT$, is negative. The $dV_R/dT$ can be substantially compensated by the $dV_{BE}/dT$ and the bandgap reference voltage is independent from the change of the temperature T.

It is found that the PTAT current should be large enough such that the $dV_R/dT$ can be desirably compensated by the $dV_{BE}/dT$. Conventionally, the PTAT current is at least in the order of several micro amperes to provide the desired voltage drop $V_R$ cross the resistor R.

For the conventional bandgap voltage reference, a start-up circuit is connected with the PTAT current source to properly set the initial condition of the PTAT current. Additionally, an operational amplifier (OP-AMP) is used to ensure stability during a steady-state operation. The start-up circuit and the OP-AMP consume a portion of the chip area of the bandgap voltage reference circuit.

Based on the foregoing, reference voltage generators, integrated circuits, systems, and method for providing a reference voltage are desired.

It is understood that the following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "below," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

FIG. 1 is a schematic drawing illustrating an exemplary reference voltage generator. A reference voltage generator 100 can include a proportional to absolute temperature (PTAT) current source 110. The PTAT current source 110 can provide a first current, e.g., a current $I_{PTAT1}$, that is proportional to a temperature, e.g., an absolute temperature T. The reference voltage generator 100 can include a voltage divider 120. The voltage divider 120 can receive a second current, e.g., a current $I_{PTAT2}$. The current $I_{PTAT2}$ can be proportional to the current $I_{PTAT1}$. In various embodiments, the current $I_{PTAT2}$ can be proportional to the temperature T. The voltage divider 120 can output a reference voltage $V_{ref}$. The reference voltage $V_{ref}$ can be substantially independent from a change of the temperature T. In various embodiments, $dVref/dT \approx 0$.

The current generated by the PTAT current source 110 can be mirrored, flowing through a MOSFET-only voltage divider 120 to generate the desired reference voltage $V_{ref}$. The reference voltage $V_{ref}$ is substantially independent from the change of the temperature.

Referring to FIG. 1, the PTAT current source 110 can include a transistor 111, e.g., an npn bipolar transistor, a transistor 113, e.g., an npn bipolar transistor, and a resistor 115. An emitter of the transistor 111 can be connected with a voltage source, e.g., VSS. Bases of the transistors 111 and 113 can be connected with each other. A collector of the transistor 113 can be connected with the base of the transistor 113. The resistor 115 can be connected with an emitter of the transistor 113. The resistor 115 can have a resistance $R_1$. It is noted that the PTAT current source 110 described above is merely exemplary. MOS transistors, e.g., PMOS and/or NMOS transistors, and/or pnp bipolar transistors can be used to form a desired PTAT current source 110.

As noted, the current $I_{PTAT2}$ can be proportional to the temperature T. In various embodiments, the current $I_{PTAT2}$ can be expressed as equation (1) shown below.

$$I_{PTAT2} \approx \frac{kT}{q} \times \frac{C}{R_1} \tag{1}$$

wherein k is Boltzmann's constant, T is the absolute temperature, q is the elementary charge constant, $R_1$ is the resistance of the resistor 115, and C is a constant.

Referring to FIG. 1, the voltage divider 120 can include a transistor 121, e.g., a PMOS transistor, and a transistor 123, e.g., an NMOS transistor. Gates of the transistors 121 and 123 can be connected with each other. The gates of the transistors 121 and 123 can be connected with drains of the transistors 121 and 123 and an output end of the reference voltage generator 100. A source of the transistor 123 can be connected with a voltage source, e.g., VSS. It is noted that the type and/or number of the transistors 121 and 123 described above in conjunction with FIG. 1 are merely exemplary. One of skill in the art can modify them to achieve the desired power consumption. In various embodiments using a PMOS transistor for the transistor 121, a power supply rejection ratio (PSRR) can be desirably increased.

Referring to FIG. 1, a current mirror circuit 130 can be connected with the reference voltage generator 110 and the voltage divider 120. The current mirror circuit 130 can include, e.g., transistors 131, 133, 135, and 137. By biasing gates of the transistors 133, 135, and 137 on the same voltage, the currents $I_{PTAT1}$, $I_{PTAT2}$, and $I_{PTAT3}$ can be proportional to each other. For example, the current $I_{PTAT1}$ and the current $I_{PTAT2}$ can have a ratio. The ratio of $I_{PTAT1}/I_{PTAT2}$ can be adjusted by, for example, modifying a ratio of a width of the transistor 135 to a width of the transistor 137.

In various embodiments operating the reference voltage generator 100 in a steady state, the reference voltage $V_{ref}$ can be substantially equal to a voltage drop ($V_{GS}$) between the gate and the source of the transistor 123. A current flowing through the transistor 123 can be substantially equal to the current $I_{PTAT2}$. In various embodiments, the current $I_{PTAT2}$ can be expressed as equation (2) shown below.

$$I_{PTAT2} = \frac{\mu_n C_{ox}}{2} \times \frac{W}{L}(V_{ref} - V_{th})^2 \tag{2}$$

wherein $\mu_n$ is an electronic mobility, $C_{ox}$ is a capacitance of the gate dielectric of the transistor 123, W is a width of the transistor 123, L is a length of the transistor 123, and $V_{th}$ is a threshold voltage of the transistor 123.

From the equation (2), the reference voltage $V_{ref}$ can be expressed as equation (3) shown below.

$$V_{ref}(2I_{PTAT2}L/\mu_n C_{ox}W)^{1/2}+V_{th} \tag{3}$$

As shown in the equation (3), the reference voltage $V_{ref}$ can include a first voltage, e.g., $(2I_{PTAT2}L/\mu_n C_{ox}W)^{1/2}$, and a second voltage, e.g., the threshold voltage $V_{th}$ of the transistor 123. The first voltage $(2I_{PTAT2}L/\mu_n C_{ox}W)^{1/2}$ can include the current $I_{PTAT2}$ as a factor. The second voltage $V_{th}$ can include the threshold voltage $V_{th}$ of the transistor 123 as a factor.

The change of the reference voltage $V_{ref}$ in response to the change of the temperature T can be expressed as equation (4) shown below.

$$dV_{ref}/dT=dV_{th}/dT+(2L/\mu_n C_{ox}W)^{1/2}\times 1/\sqrt{I_{PTAT2}}\times dI_{PTAT2}/dT \tag{4}$$

As noted, the current $I_{PTAT2}$ is proportional to the temperature T. A change of the first voltage $(2I_{PTAT2}L/\mu_n C_{ox}W)^{1/2}$ in response to the change of the temperature T, i.e., $(2L/\mu_n C_{ox}W)^{1/2}\times 1/\sqrt{I_{PTAT2}}\times dI_{PTAT2}/dT$, can be positive. A change of the threshold Voltage $V_{th}$ of the transistor 123 in response to the change of the temperature T, i.e., $dV_{thn}/dT$, can be negative. In various embodiments, $(2L/\mu_n C_{ox}W)^{1/2}\times 1/\sqrt{I_{PTAT2}}\times dI_{PTAT2}/dT$ can be substantially compensated by $dV_{thn}/dT$. The reference voltage $V_{ref}$ can be substantially independent from the change of the temperature T. $dV_{ref}/dT$ can be substantially equal to zero.

As noted, the reference voltage of the conventional bandgap voltage reference circuit is equal to the voltage drop $V_R$ cross the transistor R and the voltage drop $V_{BE}$ cross the emitter and the base of the bipolar transistor. The PTAT current should be large enough such that $dV_R/dT$ can be desirably compensated by $dV_{BE}/dT$. The power consumed by the conventional bandgap voltage reference circuit is undesired.

In contrary, the reference voltage generator 100 includes the voltage divider 120. The reference voltage $V_{ref}$ can be substantially equal to $V_{th}+(2I_{PTAT2}L/\mu_n C_{ox}W)^{1/2}$. The reference voltage $V_{ref}$ can be free from including a voltage drop generated from the current $I_{PTAT2}$ flowing through a resistor. In various embodiments, a current consumed by operating the reference voltage generator 100 can be about 500 nA that is substantially smaller than the PTAT current of the conventional bandgap voltage reference circuit. The power consumed by the reference voltage generator 100 can be desired.

Figure 2:
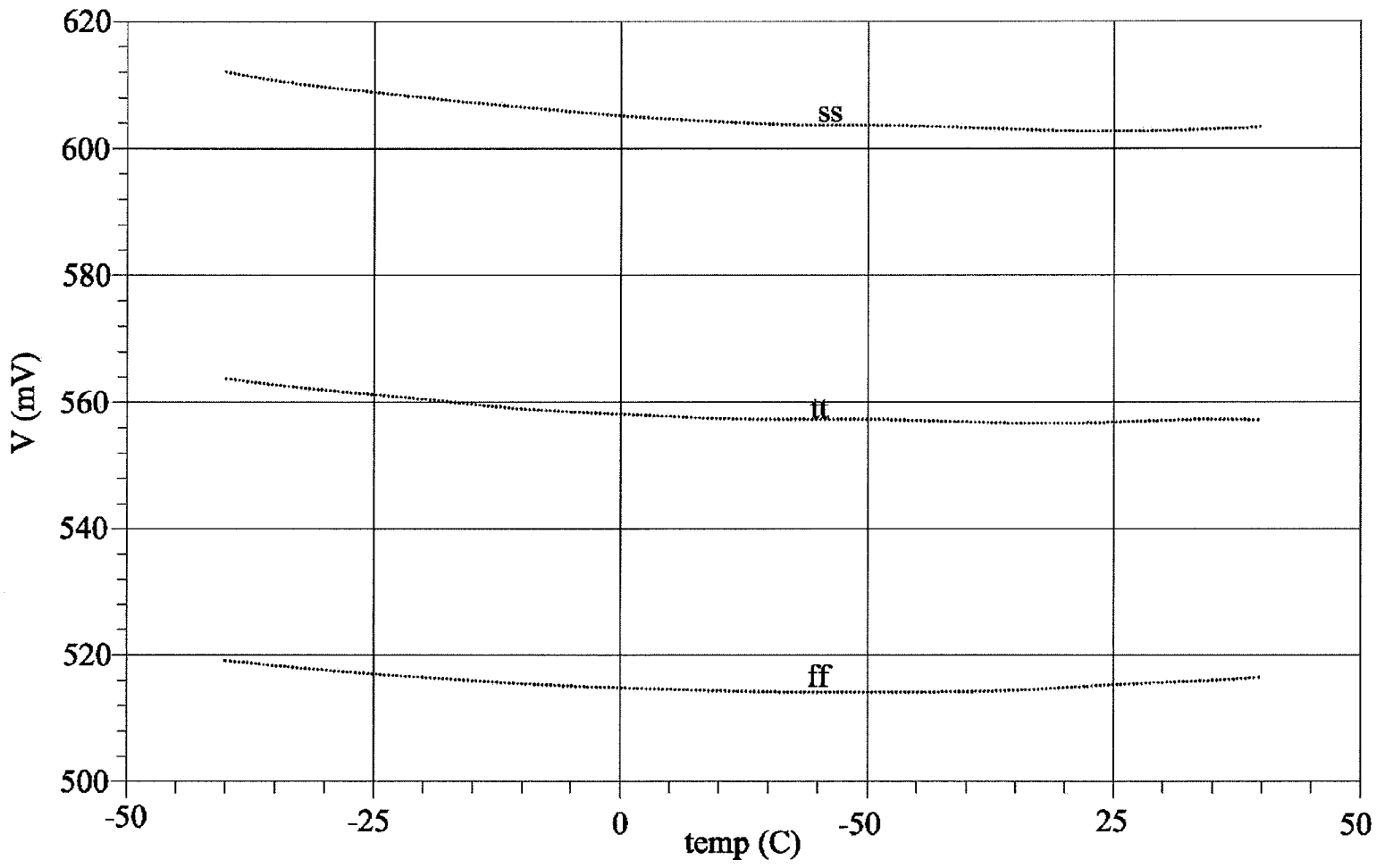
FIG. 2 is a drawing illustrating simulation results of reference voltage $V_{ref}$ v.s. temperature T at different process corners.

FIG. 2 is a drawing illustrating simulation results of reference voltage $V_{ref}$ v.s. temperature T at different process corners. In FIG. 2, the reference voltages $V_{ref}$ at different process concerns, e.g., slow-slow (ss), typical-typical (tt), and fast-fast (ff), can be separated. Slow-slow, typical-typical, and fast-fast means that NMOS and PMOS transistors have high threshold voltages, medium threshold voltages, and threshold voltages, respectively, in different process corners. In various embodiments, the change of the reference voltage $V_{ref}$ at each of the process concerns can be substantially independent from the change of the temperature T between, for example, about 0° C. and about 50° C.

It is also found that the reference voltage $V_{ref}$ can be adjusted by changing dimensions of the transistors 121 and 123. For example, changing the width/length (W/L) ratios of the transistors 121 and 123 can provide different reference voltages $V_{ref}$ at different process corners. In various embodiments, the reference voltage $V_{ref}$ at the ss corner is larger than that at the tt corner which is larger than that at the ff corner.

Following is a description regarding initiating the reference voltage generator 100. In various embodiments, the reference voltage generator 100 can be free from including a startup circuit. Referring to FIG. 1, the reference voltage generator 100 can include a transistor 140, e.g., an NMOS transistor. The transistor 140, e.g., a drain of the transistor 140, can be connected with the current mirror circuit 130. A source of the transistor 140 can be connected with the voltage source VSS. A gate of the transistor 140 can be connected with the PTAT current source 110.

In various embodiments initiating the reference voltage generator 100, a voltage transition, e.g., rise or low-to-high transition, on the gate of the transistor 140 can substantially following a voltage transition, e.g., rise or low-to-high transition, on an input end of the current mirror circuit 130. For example, the transistors 131, 133, 135, and 137 can be cut off before initiating the reference voltage generator 100. A voltage state $V_A$ on the input end of the current mirror circuit 130 can rise toward a voltage level, e.g., VDD. The voltage state $V_B$ on the gate of the transistor 140 can substantially follow the rise of the voltage state $V_A$ on the input end of the current mirror circuit 130.

In various embodiments, the voltage state $V_B$ on the gate of the transistor 140 can reach and/or exceed the threshold voltage of the transistor 140, turning on the transistor 140. The turned-on transistor 140 can couple the gates of the transistors 131, 133, 135, and 137 with the power source VSS, pulling down the voltage states on the gates of the transistors 131, 133, 135, and 137 toward the power source VSS. The pulled-down voltage states on the gates of the transistors 131, 133, 135, and 137 can turn on the transistors 131, 133, 135, and 137 for triggering currents $I_i$, $I_{PTAT1}$, $I_{PTAT2}$, and/or $I_{PTAT3}$ flowing through the transistors 131, 133, 135, and 137, respectively. The reference voltage generator 100 can thus be initiated.

After the reference voltage generator 100 is initiated, the PTAT current source 110 is capable of providing a negative voltage feedback to the gate of the transistor 140 to pull down the voltage state $V_B$ on the gate of the transistor 140 such that he reference voltage generator 100 can operate at a steady state. For example, the current $I_{PTAT1}$ flowing through the transistor 113 can pull up a voltage state $V_C$ between the transistors 111 and 113. The pulled-up voltage state $V_C$ and the current $I_{PTAT3}$ flowing through the transistor 111 can pull down the voltage state $V_B$ on the gate of the transistor 140. In various embodiments, the negative voltage feedback can be referred to as a shunt-shunt feedback.

In various embodiments, if the current $I_{PTAT1}$ is substantially equal to the current $I_{PTAT3}$, the reference voltage generator 100 operates at the steady state. The reference voltage $V_{ref}$ output from the reference voltage generator 100 can be substantially independent from the change of the temperature T.

As noted, the conventional bandgap voltage reference circuit uses a start-up circuit for starting up the conventional bandgap voltage reference circuit. The start-up circuit takes a portion of the conventional bandgap voltage reference circuit. In contrary to the conventional bandgap voltage reference circuit, the voltage reference generator 100 can free from including a start-up circuit. The area of the voltage reference generator 100 can be desirably reduced.

Figure 3:
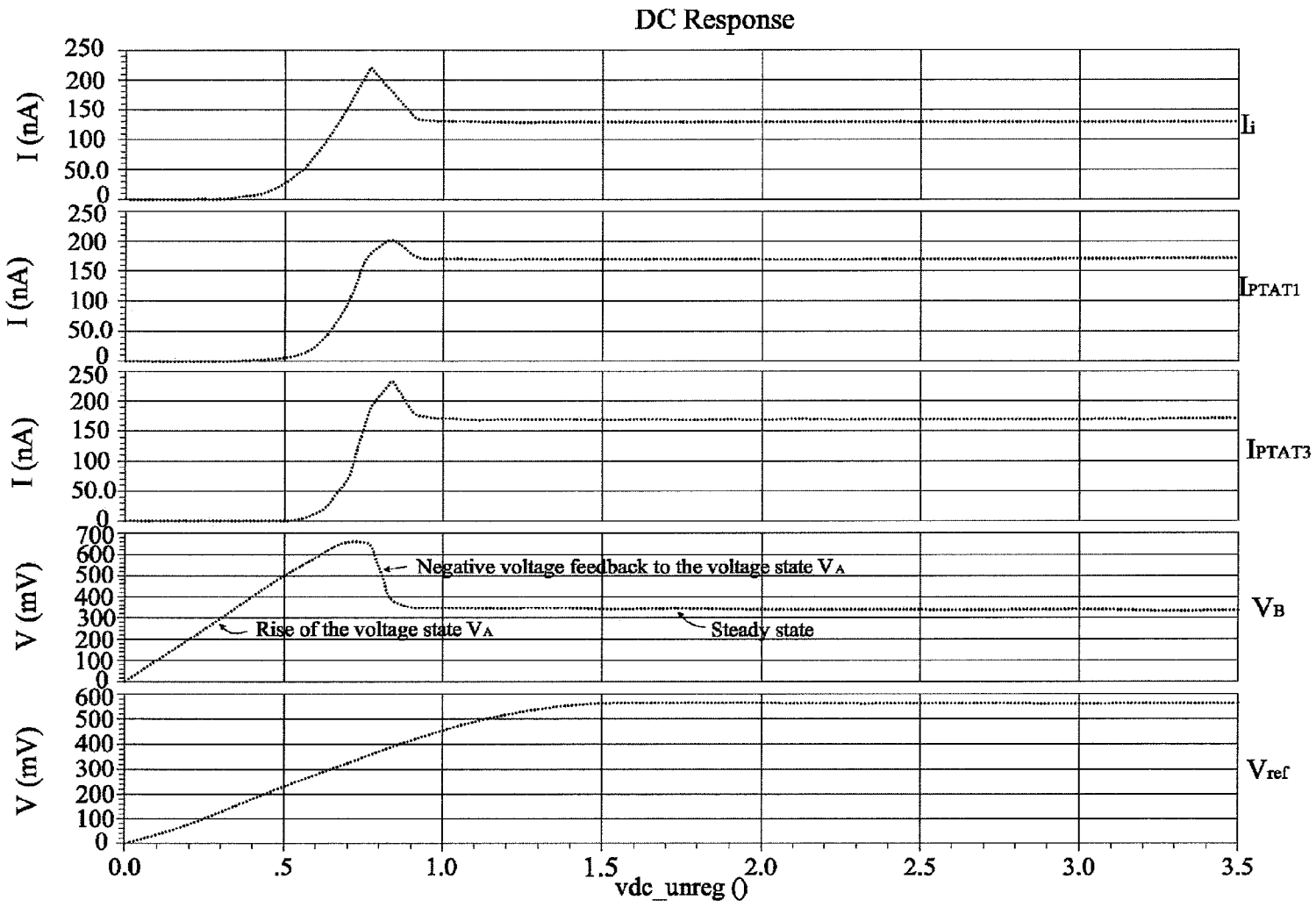
FIG. 3 is a drawing illustrating simulation results of a reference voltage $V_{ref}$, a voltage state $V_B$ on a gate of a transistor, and currents $I_i$, $I_{PTAT1}$, and $I_{PTAT3}$ in response to a DC voltage applied on an input end of a current mirror circuit.

FIG. 3 is a drawing illustrating simulation results of the reference voltage $V_{ref}$, the voltage state $V_B$ on the gate of the transistor 140, and the currents $I_i$, $I_{PTAT1}$, and $I_{PTAT3}$ in response to a DC voltage applied on the input end of the current mirror circuit 130. As shown in the simulation result, the voltage state $V_B$ on the gate of the transistor 140 rises by substantially following the voltage state on the input end of the current mirror circuit 130 at the initial state. The voltage state $V_B$ on the gate of the transistor 140 can reach and/or exceed the threshold voltage of the transistor 140 that can in turn trigger the currents $I_i$, $I_{PTAT1}$, and $I_{PTAT3}$. After a certain time period, the negative voltage feedback can be applied to the gate of the transistor 140, pulling down the voltage state $V_B$ on the gate of the transistor 140. Later, if the current $I_{PTAT1}$ is substantially equal to the current $I_{PTAT3}$, the reference voltage generator 100 operates at the steady state. The reference voltage $V_{ref}$ output from the reference voltage generator 100 can be substantially independent from the change of the temperature T.

Figure 4:
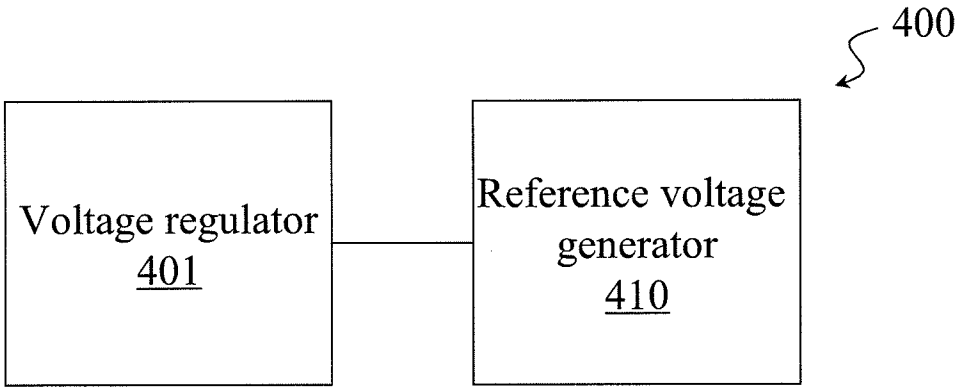
FIG. 4 is a schematic drawing showing an integrated circuit including a voltage regulator and a reference voltage generator.

FIG. 4 is a schematic drawing showing an integrated circuit including a voltage regulator and a reference voltage generator. In FIG. 4, an integrated circuit 400 can include a voltage regulator 401 connected with a reference voltage generator 410. The reference voltage generator 410 can be similar to the reference voltage generator 100 described above in conjunction with FIG. 1. The reference voltage generator 410 is capable of providing a reference voltage that is substantially independent from a change of a temperature. The voltage regulator 401 can receive an actual voltage output from a circuit and the reference voltage. The voltage regulator 401 can compare the actual voltage and the reference voltage further electrical operations. In various embodiments, the integrated circuit 400 can be a RFID circuit, a memory circuit, a logic circuit, a digital circuit, an analog circuit, other integrated circuit that uses a reference voltage, or any combinations thereof.

In various embodiments, the voltage regulator 401 and the reference voltage generator 410 can be formed within a system that can be physically and electrically connected with a printed wiring board or printed circuit board (PCB) to form an electronic assembly. The electronic assembly can be part of an electronic system such as computers, wireless communication devices, computer-related peripherals, entertainment devices, or the like.

In various embodiments, the integrated circuit 400 can provides an entire system in one IC, so-called system on a chip (SOC) or system on integrated circuit (SOIC) devices. These SOC devices may provide, for example, all of the circuitry needed to implement a cell phone, personal data assistant (PDA), digital VCR, digital camcorder, digital camera, MP3 player, or the like in a single integrated circuit.

One aspect of this description relates to a reference voltage generator. The reference voltage generator includes a proportional to absolute temperature (PTAT) current source, the PTAT current source being capable of providing a first current that is proportional to a temperature. The reference voltage generator further includes a current minor comprising a first transistor and a second transistor, the current mirror configured to generate a second current proportional to the first current, wherein a ratio of the first current to the second current is equal to a ratio of a gate width of the first transistor to a gate width of the second transistor. The reference voltage generator further includes a voltage divider, the voltage divider being capable of receiving the second current, the voltage divider capable of outputting a reference voltage, the reference voltage being substantially independent from a change of the temperature.

Another aspect of this description relates to an integrated circuit. The integrated circuit includes a voltage regulator and a reference voltage generator. The reference voltage generator includes a proportional to absolute temperature (PTAT) current source, the PTAT current source being capable of providing a first current that is proportional to a temperature.

The reference voltage generator further includes a current mirror comprising a first transistor and a second transistor, the current mirror configured to generate a second current proportional to the first current, wherein a ratio of the first current to the second current is equal to a ratio of a gate width of the first transistor to a gate width of the second transistor. The reference voltage generator further includes a voltage divider, the voltage divider being capable of receiving the second current, the voltage divider capable of outputting a reference voltage, the reference voltage being substantially independent from a change of the temperature.

Still another aspect of this description relates to a method of generating a reference voltage. The method includes generating a first current using a proportional to absolute temperature (PTAT) current source, the first current being proportional to a temperature. The method further includes generating a second current proportional to the first current using a current mirror, the current mirror comprising a first transistor and a second transistor, wherein a ratio of a gate width of the first transistor and a gate width of the second transistor is equal to a ratio of the first current to the second current. The method further includes generating the reference voltage based on the second current using a voltage divider.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A reference voltage generator comprising:

a proportional to absolute temperature (PTAT) current source, the PTAT current source being capable of providing a first current that is proportional to a temperature; a current mirror comprising a first transistor and a second transistor, the current mirror configured to generate a second current proportional to the first current, wherein a ratio of the first current to the second current is equal to a ratio of a gate width of the first transistor to a gate width of the second transistor; and a voltage divider, the voltage divider being capable of receiving the second current, the voltage divider capable of outputting a reference voltage, the reference voltage being substantially independent from a change of the temperature, wherein the voltage divider comprises a first diode-connected transistor and a second diode-connected transistor, and the reference voltage is capable of being adjusted based on width/length ratios of the first diode-connected transistor and the second diode-connected transistor, wherein the PTAT current source is further capable of providing a third current that is proportional to the first current.

2. The reference voltage generator of claim 1, wherein a gate of the first transistor is configured to receive a same voltage as a gate of the second transistor.

3. The reference voltage generator of claim 1, wherein a source of the first transistor is configured to receive a same voltage as a source of the second transistor.

4. The reference voltage generator of claim 1, wherein the first transistor and the second transistor are p-type metal oxide semiconductor (PMOS) transistors.

5. The reference voltage generator of claim 1, wherein a gate of the first diode-connected transistor is connected to a gate of the second diode-connected transistor.

6. The reference voltage generator of claim 5, wherein the gate of the first diode-connected transistor is configured to have a same voltage as the reference voltage.

7. The reference voltage generator of claim 1, wherein the first diode-connected transistor has a first dopant type and the second diode-connected transistor has a second dopant type opposite to the first dopant type.

8. An integrated circuit comprising:

a voltage regulator; and a reference voltage generator connected with the voltage regulator, the reference voltage generator comprising:

a proportional to absolute temperature (PTAT) current source, the PTAT current source being capable of providing a first current that is proportional to a temperature;

a current mirror comprising a first transistor and a second transistor, the current minor configured to generate a second current proportional to the first current, wherein a ratio of the first current to the second current is equal to a ratio of a gate width of the first transistor to a gate width of the second transistor;

a voltage divider, the voltage divider being capable of receiving the second current, the voltage divider capable of outputting a reference voltage, the reference voltage being substantially independent from a change of the temperature, wherein the voltage divider comprises a third transistor and a fourth transistor, wherein the reference voltage is capable of being adjusted based on width/length ratios of the third and fourth transistors, and a gate of the third transistor is connected to a gate of the fourth transistor; and a transistor having a gate connected to the PTAT current source and a first terminal connected to the current mirror.

9. The integrated circuit generator of claim 8, wherein a gate of the first transistor is configured to receive a same voltage as a gate of the second transistor.

10. The integrated circuit generator of claim 8, wherein a source of the first transistor is configured to receive a same voltage as a source of the second transistor.

11. The integrated circuit generator of claim 8, wherein the first transistor and the second transistor are p-type metal oxide semiconductor (PMOS) transistors.

12. The integrated circuit generator of claim 8, wherein the gate of the third transistor is configured to have a same voltage as the reference voltage.

13. The integrated circuit of claim 8, wherein the voltage regulator is configured to receive the reference voltage and a circuit output voltage.

14. The integrated circuit of claim 13, wherein the voltage regulator is configured to compare the reference voltage and the circuit output voltage.

15. The integrated circuit of claim 8, wherein the third transistor is a diode-connected transistor and the fourth transistor is a diode-connected transistor.

16. A method of generating a reference voltage, the method comprising:

generating a first current using a proportional to absolute temperature (PTAT) current source, the first current being proportional to a temperature; generating a second current proportional to the first current using a current mirror, the current mirror comprising a first transistor and a second transistor, wherein a ratio of a gate width of the first transistor and a gate width of the second transistor is equal to a ratio of the first current to the second current; generating a third current using the PTAT current source, wherein the third current is proportional to the first current; and generating the reference voltage based on the second current using a voltage divider, wherein the voltage divider comprises a pair of diode-connected transistors, wherein generating the reference voltage comprises: passing the second current through a third transistor and a fourth transistor; and selecting a width/length ratio of the third and fourth transistors.

17. The method of claim 16, wherein generating the second current comprises supplying a first voltage to a gate of the first transistor and a gate of the second transistor; and supplying a second voltage to a source of the first transistor and a source of the second transistor.

18. The method of claim 16, wherein generating the reference voltage comprises generating a reference voltage equal to:

$$V_{th}+(2I_{PTAT2}L/\mu_n C_{ox}W)^{1/2}$$

where $V_{th}$ is a threshold voltage of the third transistor, $I_{PTAT2}$ is the second current, L is a length of the third transistor, $\mu_n$ is an electron mobility, $C_{ox}$ is a capacitance of a gate dielectric of the third transistor and W is a width of the third transistor.

* * * * *